US010969189B1

(12) United States Patent
Luis y Prado

(10) Patent No.: US 10,969,189 B1
(45) Date of Patent: Apr. 6, 2021

(54) WEAPON MAINTENANCE SYSTEM

(71) Applicant: Workshops for Warriors, San Diego, CA (US)

(72) Inventor: Hernán Luis y Prado, San Diego, CA (US)

(73) Assignee: Workshops for Warriors, San Diego, CA (US)

( * ) Notice: Subject to any disclaimer, the term of this patent is extended or adjusted under 35 U.S.C. 154(b) by 0 days.

(21) Appl. No.: 16/777,474

(22) Filed: Jan. 30, 2020

(51) Int. Cl.
*F41A 23/52* (2006.01)
*F41A 27/18* (2006.01)
*B65D 19/44* (2006.01)

(52) U.S. Cl.
CPC ..... *F41A 23/52* (2013.01); *B65D 19/44* (2013.01); *F41A 27/18* (2013.01); *B65D 2519/00273* (2013.01); *B65D 2519/00786* (2013.01); *B65D 2519/00815* (2013.01)

(58) Field of Classification Search
CPC ..... F41A 23/16; F41A 23/26; F41A 23/52; F41A 27/18; B65D 19/06; B65D 19/08; B65D 19/44
USPC ..... 89/37.13
See application file for complete search history.

(56) References Cited

U.S. PATENT DOCUMENTS 2,425,783 A * 8/1947 Buquor ..... F41A 23/46 89/40.01
2,491,608 A 12/1949 Duplessis
2,557,960 A * 6/1951 Gerhardt ..... F41A 23/54 89/37.05
2,870,980 A * 1/1959 Higgins ..... B65D 19/385 108/53.5
5,413,052 A 5/1995 Breezer
6,889,948 B2 5/2005 Melancon
8,707,849 B1 * 4/2014 Root ..... F41A 23/54 89/37.05
10,466,008 B2 11/2019 Luis y Prado
2009/0031890 A1 * 2/2009 Trigo ..... F41A 23/005 89/37.13
2009/0183442 A1 7/2009 Repasky
2010/0257999 A1 * 10/2010 Domholt ..... F41A 27/20 89/41.02

(Continued)

OTHER PUBLICATIONS

Sales quote documents dated between Jul. 25, 2014 and Jul. 18, 2016 for a weapons maintenance stand (15 pages).

(Continued)

*Primary Examiner* — Bret Hayes
(74) *Attorney, Agent, or Firm* — Fish & Richardson P.C.

(57) ABSTRACT

In one aspect the invention features a weapon maintenance stand cover. The cover has a top cover plate, a wall structure, and a flange. The wall structure extends away from an outer edge of the top cover plate in a direction substantially perpendicular to a bottom surface of the top cover plate. The flange extends outward from a bottom edge of the wall structure and around a perimeter of the wall structure and is sized to mate with a support flange of a weapon maintenance stand. The flange defines a first plurality of holes extending therethrough, where the first plurality of holes are arranged in a spaced-apart pattern around the flange that aligns with a subset of a second plurality of holes arranged around the support flange of the weapon maintenance stand. First and second lifting structures are attached to the top cover plate.

20 Claims, 14 Drawing Sheets

(56) References Cited

U.S. PATENT DOCUMENTS

| | | | | |
|---|---|---|---|---|
| 2011/0132239 | A1 | 6/2011 | Poulsen | |
| 2012/0103848 | A1* | 5/2012 | Allegretti | B65D 77/061 206/386 |
| 2017/0073105 | A1* | 3/2017 | Eding | B65D 19/0026 |

OTHER PUBLICATIONS

Purchase order 342447 dated Mar. 4, 2015 (6 pages).
Photos of weapons maintenance stand (2 pages).
Engineering drawings of weapons maintenance stand (14 pages).
Engineering drawings of weapons maintenance stand (13 pages).
The PDI Group, "Maintenance Stands", https://web.archive.org/web/20150822152744/http:/www.thepdigroup.com/Products/6, Aug. 22, 2015.
The PDI Group, "20 MM Gun Maintenance Stand", http://www.thepdigroup.com/ProductDetails/32, Aug. 22, 2015.

* cited by examiner

WEAPON MAINTENANCE SYSTEM

TECHNICAL FIELD

This specification relates to maintenance equipment for military weapon systems.

BACKGROUND

Various military weapon systems may be very heavy, unbalanced, delicate, and/or awkward to move. Consequently, such loads are typically moved with cranes and rigged with wooden blocking, dunnage, and straps for shipping. These techniques are costly, time-intensive, and rely on operator skill to be performed safely and repeatedly. In addition, mounted weapons systems may include delicate umbilicals (e.g., cabling, wires, hoses, waveguides, etc.) that are used to control the weapon system and which extend from the bottom of the weapons system. The umbilicals may be prone to damage due to improper handling.

SUMMARY

In a first general aspect a weapon support system includes a weapon maintenance stand, a weapon maintenance stand cover, and a pallet. The weapon maintenance stand includes a base plate, a support flange, a wall structure, and an umbilical guide structure. The base plate defines a first plurality of holes extending through the base plate and a second plurality of holes extending through the base plate. The support flange is spaced from the base plate, and the support flange defines a third plurality holes extending through the support flange. The wall structure is attached to the base plate at a first end and attached to the support flange at a second end. The wall structure defines a tunnel extending through the wall. A plurality of braces are attached to the wall structure and the base plate to support the wall structure. The umbilical guide structure is attached to the base plate and located within a perimeter defined by the wall structure A deck-mounted weapon system is mounted to the support flange such that umbilical components of the deck-mounted weapon system pass through the umbilical guide structure and through the tunnel, wherein a subset of the third plurality of holes are configured to match a pattern of bolt holes of a deck-mounted weapon system and at least one of the third plurality of holes is configured to receive an alignment structure of the deck-mounted weapon system, and wherein the first plurality of holes are located outside of the perimeter and the second plurality of holes are located inside the perimeter. The weapon maintenance stand cover configured to mate with the support flange of the weapon maintenance stand with the deck-mounted weapon system unmounted. The pallet includes a top plate, a base structure, and a plurality of support legs. The top plate defines a fourth plurality of holes extending through the top plate and a fifth plurality of holes extending through the top plate, locations of the fourth plurality of holes corresponding to respective locations of the first plurality of holes of the weapon maintenance stand base plate and locations of the fifth plurality of holes corresponding to respective locations of the second plurality of holes of the weapon maintenance stand base plate. The base structure is spaced apart from the top plate. The plurality of support legs are attached to the top plate at respective first ends, and, at least a portion of the plurality of support legs being attached to the base structure at respective second ends. This and other implementations can include one or more of the following features.

In some implementations, the weapon maintenance stand cover includes a top cover plate, a wall structure, and a flange. The wall structure extends away from an outer edge of the top cover plate in a direction substantially perpendicular to a bottom surface of the top cover plate. The flange extends outward from a bottom edge of the wall structure around a perimeter of the wall structure, wherein the flange is sized to mate with a support flange of a weapon maintenance stand.

In some implementations, the flange defines a sixth plurality of holes extending therethrough, the sixth plurality of holes arranged in a spaced-apart pattern around the flange, wherein the pattern of the sixth plurality of holes matches with a subset of the third plurality of holes extending through the support flange of the weapon maintenance stand.

In some implementations, the weapon maintenance stand cover includes a first lifting structure and a second lifting structure attached to a top surface of the top cover plate and spaced apart from one another.

In some implementations, both the first lifting structure and the second lifting structure are sized to receive a forklift fork.

In some implementations, the first lifting structure includes a first pair of handles and the second lifting structure includes a second pair of handles.

In some implementations, each of the first lifting structure and the second lifting structure include an elongated enclosure defining a channel extending between openings at each end of the enclosure, where a width of each opening is sized to receive a forklift fork.

In some implementations, the deck-mounted weapon system is a MK-38 weapon system.

In a second general aspect, a weapon maintenance system includes a base plate, a support flange, a wall structure, and a cover. The support flange is spaced from the base plate, and the support flange defines a first plurality holes extending through the support flange. The wall structure is attached to the base plate at a first end and attached to the support flange at a second end, and the wall structure defines a tunnel extending through the wall. A deck-mounted weapon system is mounted to the support flange such that umbilical components of the deck-mounted weapon system pass through the tunnel, wherein a subset of the first plurality of holes are configured to match a pattern of bolt holes of a deck-mounted weapon system and at least one of the first plurality of holes is configured to receive an alignment structure of the deck-mounted weapon system. The cover is configured to mate with the support flange with the deck-mounted weapon system unmounted.

In some implementations, the cover includes, a top cover plate, a wall structure, and a flange. The wall structure extends away from an outer edge of the top cover plate and in a direction substantially perpendicular to a bottom surface of the top cover plate. The flange extends outward from a bottom edge of the wall structure and around a perimeter of the wall structure, where the flange is sized to mate with a support flange of a weapon maintenance stand.

In some implementations, the flange defines a second plurality of holes extending therethrough, the second plurality of holes arranged in a spaced-apart pattern around the flange, wherein the pattern of the second plurality of holes matches with a subset of the first plurality of holes extending through the support flange of the weapon maintenance stand.

In some implementations, cover includes a first lifting structure and a second lifting structure attached to a top surface of the top cover plate and spaced apart from one another.

In some implementations, both the first lifting structure and the second lifting structure are sized to receive a forklift fork.

In some implementations, the first lifting structure includes a first pair of handles and the second lifting structure includes a second pair of handles.

In some implementations, each of the first lifting structure and the second lifting structure include an elongated enclosure defining a channel extending between openings at each end of the enclosure, wherein a width of each opening is sized to receive a forklift fork or lifting slings.

In a third general aspect, a weapon maintenance stand cover includes a top cover plate, a wall structure, a flange, a first lifting structure, and a second lifting structure. The wall structure extends away from an outer edge of the top cover plate and in a direction substantially perpendicular to a bottom surface of the top cover plate. The flange extends outward from a bottom edge of the wall structure and around a perimeter of the wall structure, where the flange is sized to mate with a support flange of a weapon maintenance stand, and where the flange defines a first plurality of holes extending therethrough, the first plurality of holes arranged in a spaced-apart pattern around the flange that aligns with a subset of a second plurality of holes arranged around the support flange of the weapon maintenance stand. The first lifting structure and the second lifting structure are attached to a top surface of the top cover plate and spaced apart from one another, where both the first lifting structure and the second lifting structure are sized to receive a forklift fork or lifting slings.

In some implementations, the first lifting structure includes a first pair of handles and the second lifting structure includes a second pair of handles.

In some implementations, each of the first lifting structure and the second lifting structure include an elongated enclosure defining a channel extending between openings at each end of the enclosure, wherein a width of each opening is sized to receive a forklift fork or lifting slings.

In some implementations, weapon maintenance stand cover includes at least one of steel and aluminum.

In some implementations, the flange has a circular-shape defining a central void.

Details of one or more implementations of the subject matter described in this specification are set forth in the accompanying drawings and the description below. Other features, aspects, and potential advantages of the subject matter will become apparent from the description, the drawings, and the claims.

DETAILED DESCRIPTION

Figure 1:
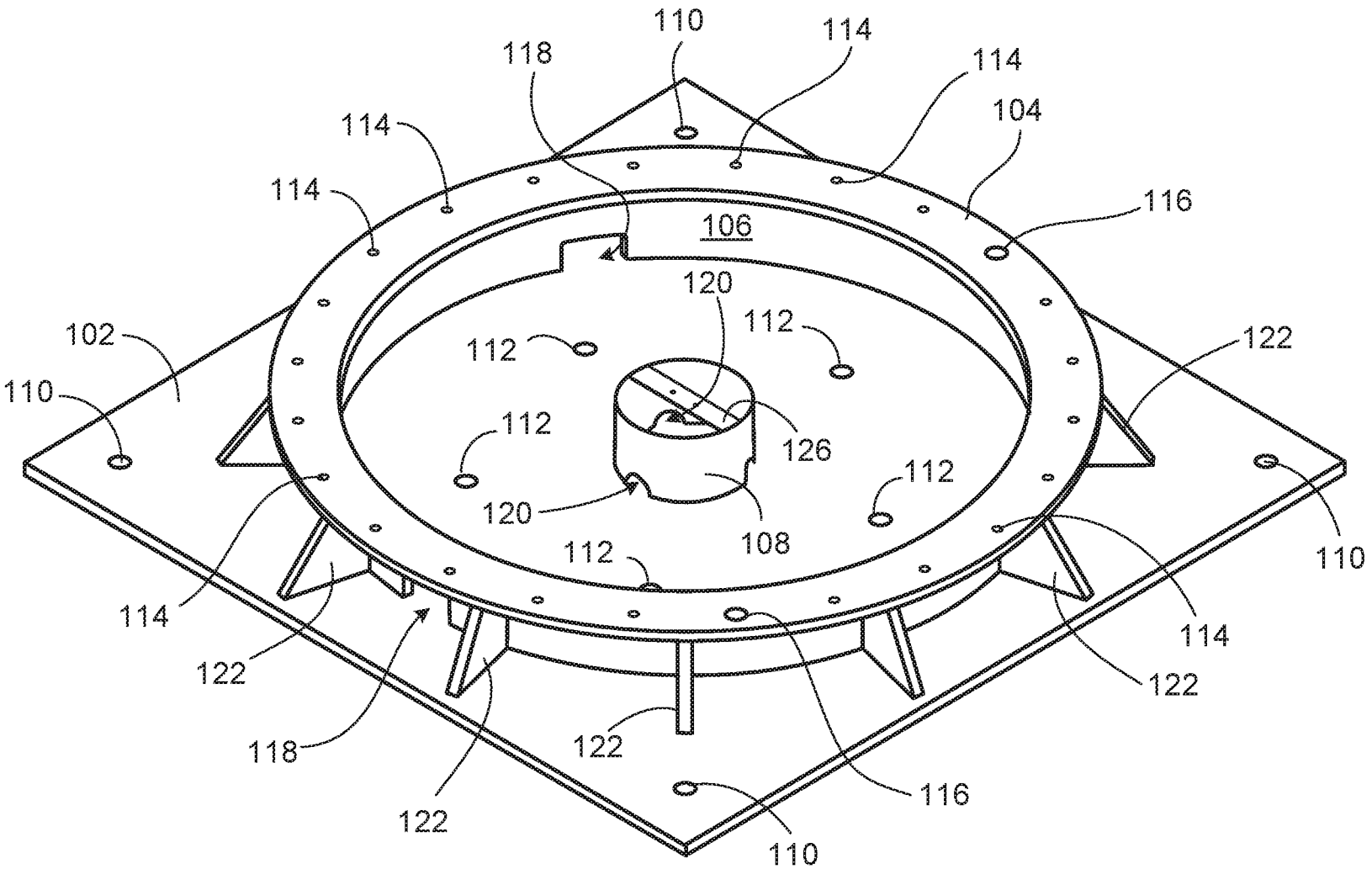
FIG. 1 is a perspective view of an exemplary weapon maintenance stand according to implementations of the present disclosure.

The invention described in this specification is a type of weapon maintenance system. The weapon maintenance system includes a weapon maintenance stand, a pallet, and a cover. The weapon maintenance system may provide several advantages over the current methods of transporting and maintaining deck mounted weapon systems (e.g., Mk38 25 mm machine gun, Mk110 57 mm Gun System, and similar weapon systems). Using the weapon maintenance system, weapon systems, such as deck-mounted weapons systems, can be safely transported and secured during maintenance without blocking, damaging, or severing the umbilicals of the weapons system. In addition, by allowing the umbilicals to be accessible and protected from damage, the weapons maintenance system permits operation and testing of a weapons system while it is mounted to the weapon maintenance system.

The weapon maintenance stand, which carries the weapon system, can be secured to a pallet. By attaching the maintenance stand to a pallet, the weapon system, when placed on the weapon maintenance stand, can be easily moved by forklift, pallet jack, crane or other industrial vehicle. This eliminates costly, time-consuming, and, potentially, dangerous rigging and blocking. This provides control and stability to the movement of the often unbalanced and delicate weapon system when transporting the system from one location to another.

Additionally, the pallet may be secured to a surface, which further stabilizes the weapon system by preventing movement of the system during transport or while performing maintenance, disassembly, or re-assembly on the system. By allowing the umbilicals to be inserted through openings in the weapon maintenance stand, the umbilicals are not crushed or twisted, and are therefore less likely to be damaged.

Additionally, by not blocking the umbilicals that control weapon functionality, the weapon maintenance system may permit post-maintenance testing of the weapon system while the weapon system is secured to the weapon maintenance stand. The weapon maintenance cover may be placed over the remaining hole in the deck or the vehicle once the weapon system has been moved and secured to the deck or vehicle. This eliminates a potentially dangerous maintenance location.

Additionally, the weapon maintenance cover may be secured to the weapon maintenance stand. Using the weapon maintenance cover top handles, the weapon systems cover and stand can be safely transported by forklift, pallet jack, or other industrial vehicle, rather than by crane.

In some implementations, the weapon maintenance stand can be installed in a vehicle, vessel or in locations which were not previously designed to accommodate a particular weapon system that can be mounted on the weapon maintenance stand. For example, the weapon maintenance stand or weapon maintenance system can be mounted on a truck or trailer, thus, enabling a weapon system such as the Mk38 to be mounted and used on a truck, trailer, or vessel e.g., one that did not have a weapon system mount installed.

Figure 2:
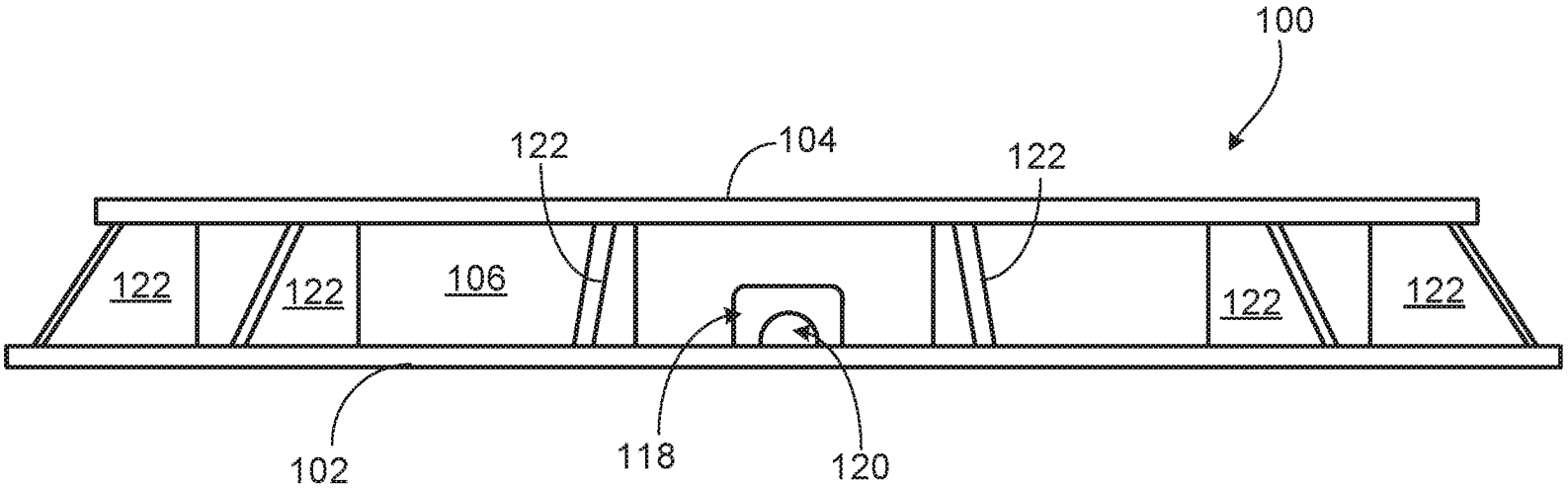
FIG. 2 is a side view of the weapon maintenance stand of FIG. 1.
Figure 3:
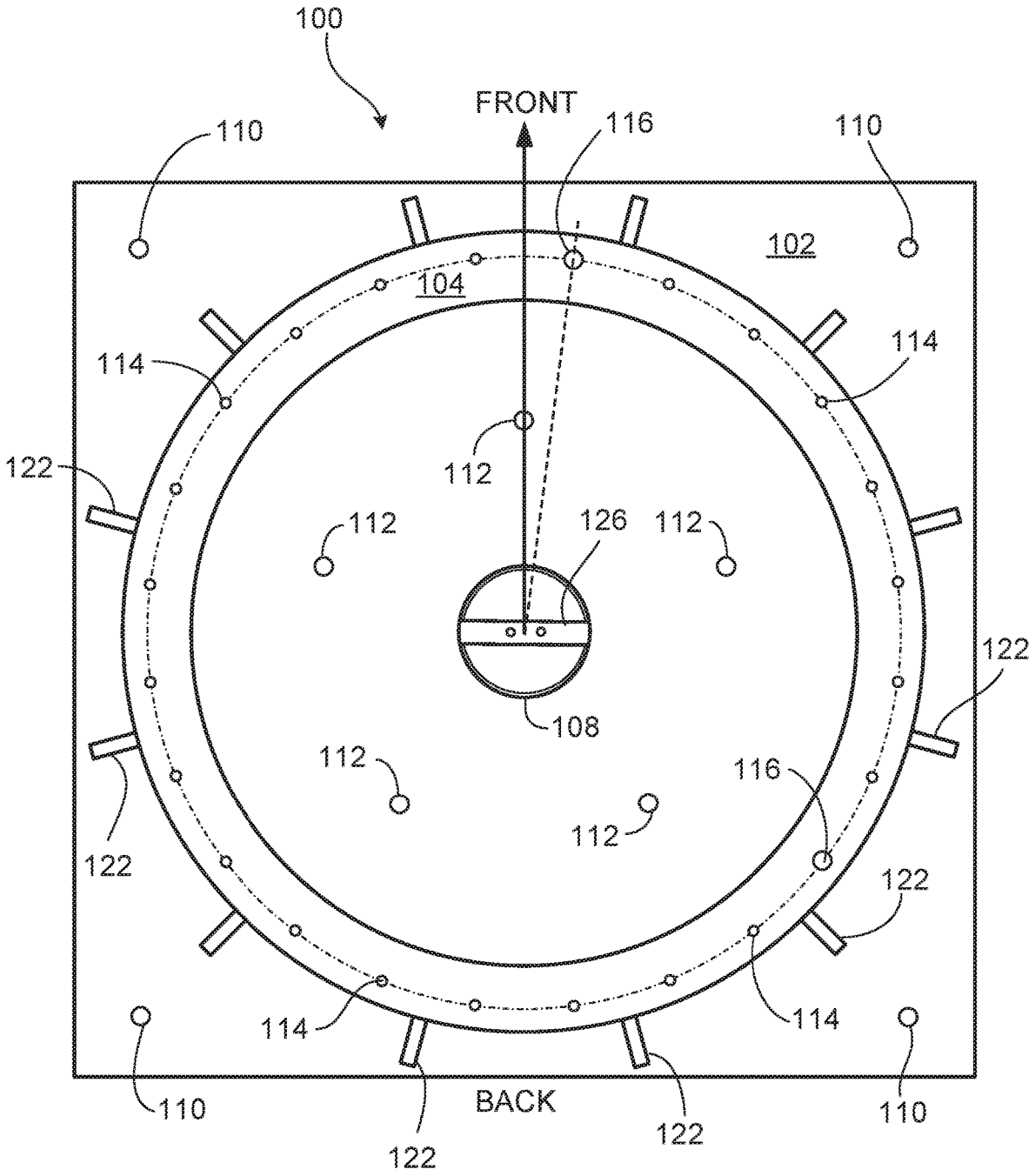
FIG. 3 is a top view of the weapon maintenance stand of FIG. 1.

FIGS. 1-3 show perspective, side, and top views of an exemplary weapon maintenance stand 100. The weapon maintenance stand 100 includes a base plate 102, a support flange 104, and a wall structure 106. In some implementations, weapon maintenance stand 100 includes an umbilical guide structure 108. The umbilical guide structure 108 protects the weapon system's umbilical equipment (e.g., umbilical cabling, hoses, hydraulics, waveguides, etc.). In some implementations, weapon maintenance stand 100 includes braces 122 to provide added structural support to wall structure 106 and support flange 104.

As shown in FIG. 1, base plate 102 has a rectangular shape. In some implementations, base plate 102 has a square shape. For example, base plate 102 can be a 56 inch by 56 inch square. In some implementations, base plate 102 may be other shapes (e.g., round or triangular) or sizes depending on the desired application. In other implementations, base plate 102 can be constructed to accommodate particular weapon systems (e.g., Mk38 25 mm machine gun, MK110, MK15 Phalanx, Raytheon SeaRAM). For example, base plate 102 can be 48 inches by 48 inches, 48 inches by 40 inches, 60 inches by 36 inches, 36 inches by 36 inches, or 24 inches by 24 inches.

Base plate 102 includes a first set of holes 110 that extend through base plate 102. Holes 110 provide openings for securing mechanisms, such as bolts, to be attached to weapon maintenance stand 100. This allows weapon maintenance stand 100 to be secured during transportation and maintenance. Holes 110 are located outside the perimeter defined by the wall structure 106. In one implementation, holes 110 are located in the four corners of base plate 102. Holes 110 can be constructed to accommodate a variety of mechanisms or fasteners used to secure pallet 200 (e.g., bolts).

Figure 10:
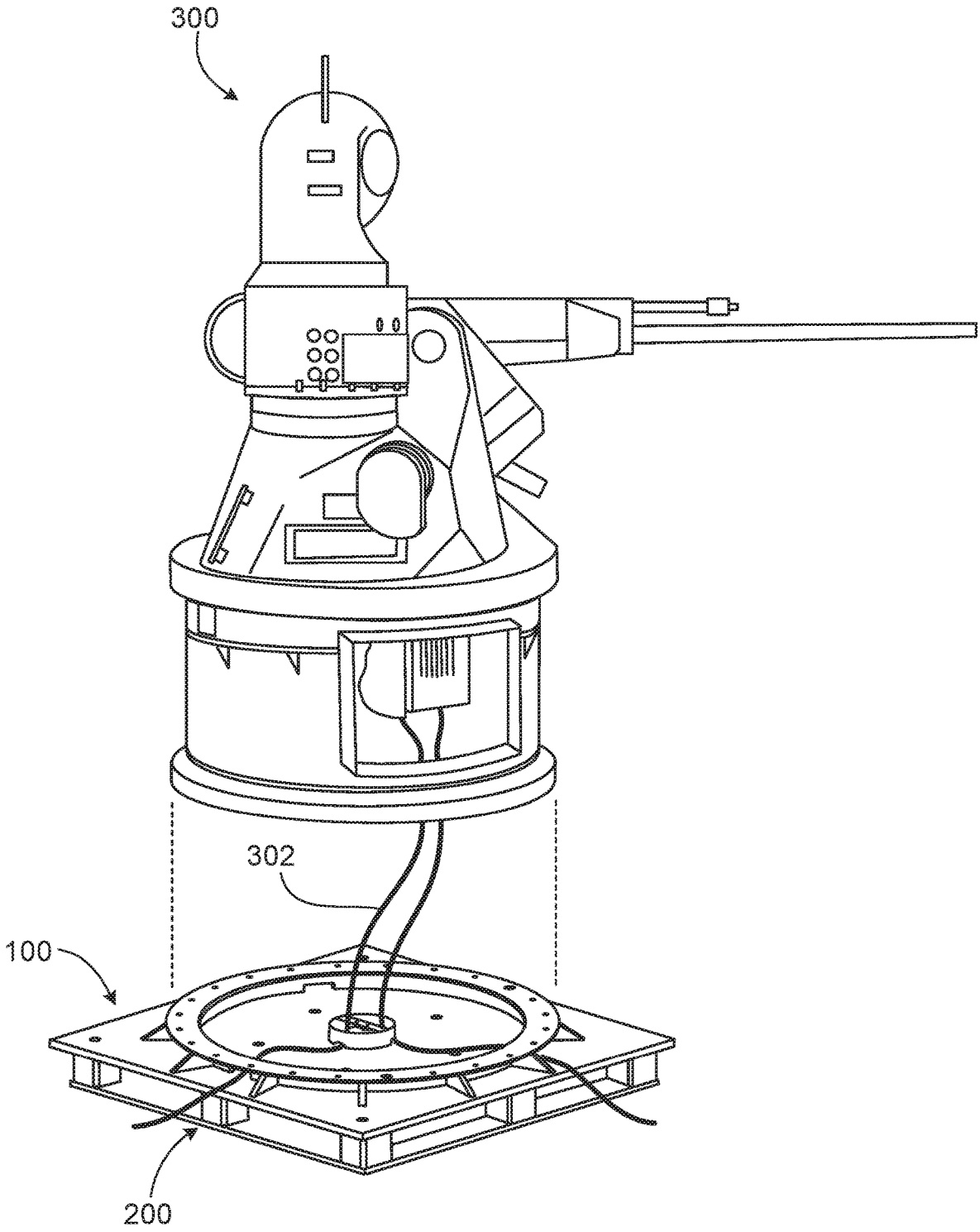
FIG. 10 is a perspective view illustrating a weapon system being mounted to a weapon maintenance system.

The base plate 102 also includes a second set of holes 112 that extend through the base plate 102. Holes 112 provide openings for attachment of bolts on the weapon system to the weapon maintenance stand 100. This allows a weapon system to be secured to weapon maintenance stand 100. Holes 112 are sized to receive bolts of a deck-mounted weapon system (e.g. weapon system 300 (as shown in FIG. 10)). As shown in FIG. 3, holes 112 are located within the perimeter defined by wall structure 106. Holes 112 can be configured on base plate 102 to match the bolt pattern of a weapon system.

Support flange 104 is attached to wall structure 106 of weapon maintenance stand 100. In one implementation, support flange 104 can be joined to wall structure 106 using welding techniques. In some implementations, support flange 104 can be circular-shaped, as shown in FIG. 1. In other implementations, support flange 104 can be different shapes (e.g. oval, rectangular) to accommodate a specific weapon system. Support flange 104 defines a central void on weapon maintenance stand 100.

Support flange 104 also includes a set of holes 114 extending through the support flange 104. Holes 114 are sized to receive bolts of a weapon system. In some implementations, holes 114 can be configured to match the bolt pattern of a weapon system.

Holes 116 on support flange 104 are configured to receive an alignment structure of a weapon system. Holes 116 function to keep a weapon system in a forward facing position when placed on weapon maintenance stand 100. This allows for more efficient and safe transport and repair of the weapon system by preventing any substantial relative movement between the system and weapon maintenance stand 100. As shown in FIG. 3, holes 116 can be offset from the front of weapon maintenance stand 100, for example, to match the location of alignment structures on a particular type of weapon system. For example, one of holes 116 can be spaced approximately 7.5 degrees from an axis of support flange 104 that extends between a front and a back of support flange 104 to match an alignment structure of a Mk38 weapon system. Holes 116 can also be constructed with different diameters to accommodate different weapon systems.

Wall structure 106 of weapon maintenance stand 100 is attached to both base plate 102 and support flange 104. As can be seen in FIG. 2, wall structure 106 offsets support flange 104 from base plate 102. In some implementations, wall structure 106 of weapon maintenance stand 100 is supported by a set of braces 122. Braces 122 are attached on one side to wall structure 106 and on another side to base plate 102. In some implementations, braces 122 can be attached to wall structure 106 using welding techniques. Braces 122 provide support to wall structure 106 against the downward force transferred from the payload to support flange 104 to wall structure 106, such as the weight of a weapon system. In other implementations, weapon maintenance stand 100 does not include braces 122. For example, if the intended force to be exerted on the weapon maintenance stand 100 by the weapon system is small enough so as to be withstood by the flange 104 and wall structure 106 alone, braces 122 can be omitted.

Wall structure 106 includes at least one tunnel 118. Tunnels 118 provide an opening for the umbilicals of the weapon system to pass through weapon maintenance stand 100 without being twisted or compressed. This allows for attachment of a weapon system to weapon maintenance stand 100 without damage to the system's umbilicals. In some implementations, wall structure 106 includes several tunnels 118. Tunnels 118 are sized to accept umbilicals of a weapon system. These umbilicals can include, for example, cables, hoses, or pipes attached to the weapon system. Tunnels 118 can be constructed to accommodate a variety of umbilicals.

Figure 4:
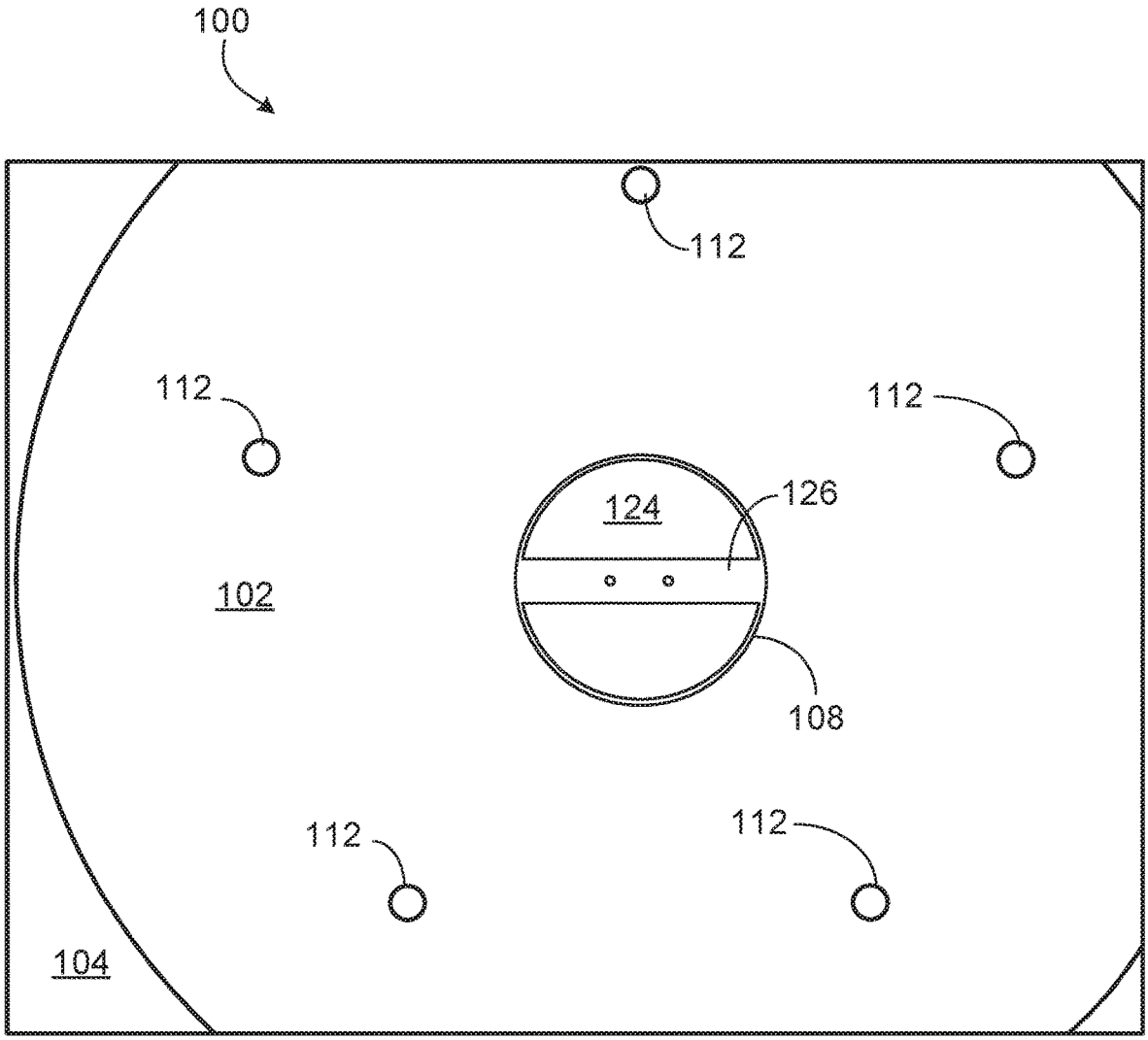
FIG. 4 is a top view showing details of an umbilical guide structure of the weapon maintenance stand of FIG. 1.

In some implementations, weapon maintenance stand 100 includes an umbilical guide structure 108. Umbilical guide structure 108 is attached to base plate 102. Umbilical guide structure 108 is located within a perimeter defined by wall structure 106. As shown in FIG. 4, the walls of umbilical guide structure 108 create an umbilical guide void 124 in which the umbilicals of a weapon system can be placed. In one implementation, the umbilical guide void 124 is cylindrically-shaped. In other implementations, the umbilical guide void 124 can be other shapes (e.g., rectangular or triangular) based on the desired implementation.

Umbilical guide structure 108 also includes a cross piece 126. The cross piece 126 can be configured couple with an umbilical securing device to secure the weapon system umbilicals (e.g., cables, hoses, etc.) to the umbilical guide structure 108. For example, an umbilical securing device can include a strap, clamp, tie, or other appropriate structure.

Umbilical guide structure 108 includes at least one umbilical guide tunnel 120. Umbilical guide tunnels 120 are sized to accept umbilicals of a weapon system. As can be seen in FIG. 2, in some implementations, umbilical guide tunnels 120 are aligned with tunnels 118 on wall structure 106. Umbilical guide tunnels 120, when aligned with tunnels 118, allow for a weapon system's umbilicals to be thread through both umbilical guide tunnels 120 and tunnels 118 without twisting or compression. This helps prevent damage to the umbilicals while the weapon system is attached to the weapon maintenance stand 100.

FIG. 4 is a close-up view of base plate 102 and umbilical guide structure 108. In some implementations, base plate 102 includes a set of holes 112 that extend through base plate 102. In some implementations, the size, location, and number of holes 112 can be selected based on a desired weapon system to be mounted on weapon maintenance stand 100. For example, as seen in FIG. 4, five holes 112 can disposed in a pentagon shape around the center of base plate 102 and within the perimeter defined by wall structure 106.

Weapon maintenance stand 100 can be configured to accommodate a variety of weapon systems (e.g., Mk38 25 mm machine gun, MK15 Phalanx, Raytheon SeaRAM). For example, the holes 112 on weapon maintenance stand 100 can be different shapes (rectangular, circular, oval, square, star-shaped, t-slotted, etc.) to accommodate strapping, banding, bolts, ratchet straps, other proprietary fastening systems. Weapon maintenance stand 100 can be formed from a variety of materials, such as steel or aluminum.

FIGS. 5-8 show perspective, side, top, and bottom views of an exemplary pallet 200. Pallet 200 includes a top plate 202, a base structure 204, and a set of support legs 206. Pallet 200 can be used to secure loads to surfaces, even upside down or during air and space transport. Pallet 200 is also reusable. Pallet 200 is environmentally friendly as pallet 200 can be used thousands of times before pallet 200 degrades or is damaged through use. Pallet 200 is easily repaired with commonly used tools and processes. Due to the distribution of support legs 206, pallet 200 is accessible via forklift, pallet-jack, or skip loader from all four sides instead of from two sides like traditional pallets. For example, components of such support systems can be inserted underneath top plate 202 of pallet 200 and between two consecutive support legs 206 from any side of pallet 200. This allows for a more controlled movement and transportation of a weapons system compared to other forms of transportation, such as by crane.

In one implementation, top plate 202 is rectangular-shaped. In other implementations, top plate 202 is square-shaped. For example, top plate 202 can be a 56 inch by 56 inch square. In some implementations, top plate 122 may be other shapes (e.g., round or triangular) or sizes depending on the desired application. In some implementations, base plate 102 can be constructed to accommodate particular weapon systems. For example, top plate 202 can be 48 inches by 48 inches, 48 inches by 40 inches, 60 inches by 36 inches, 36 inches by 36 inches, or 24 inches by 24 inches.

Figure 5:
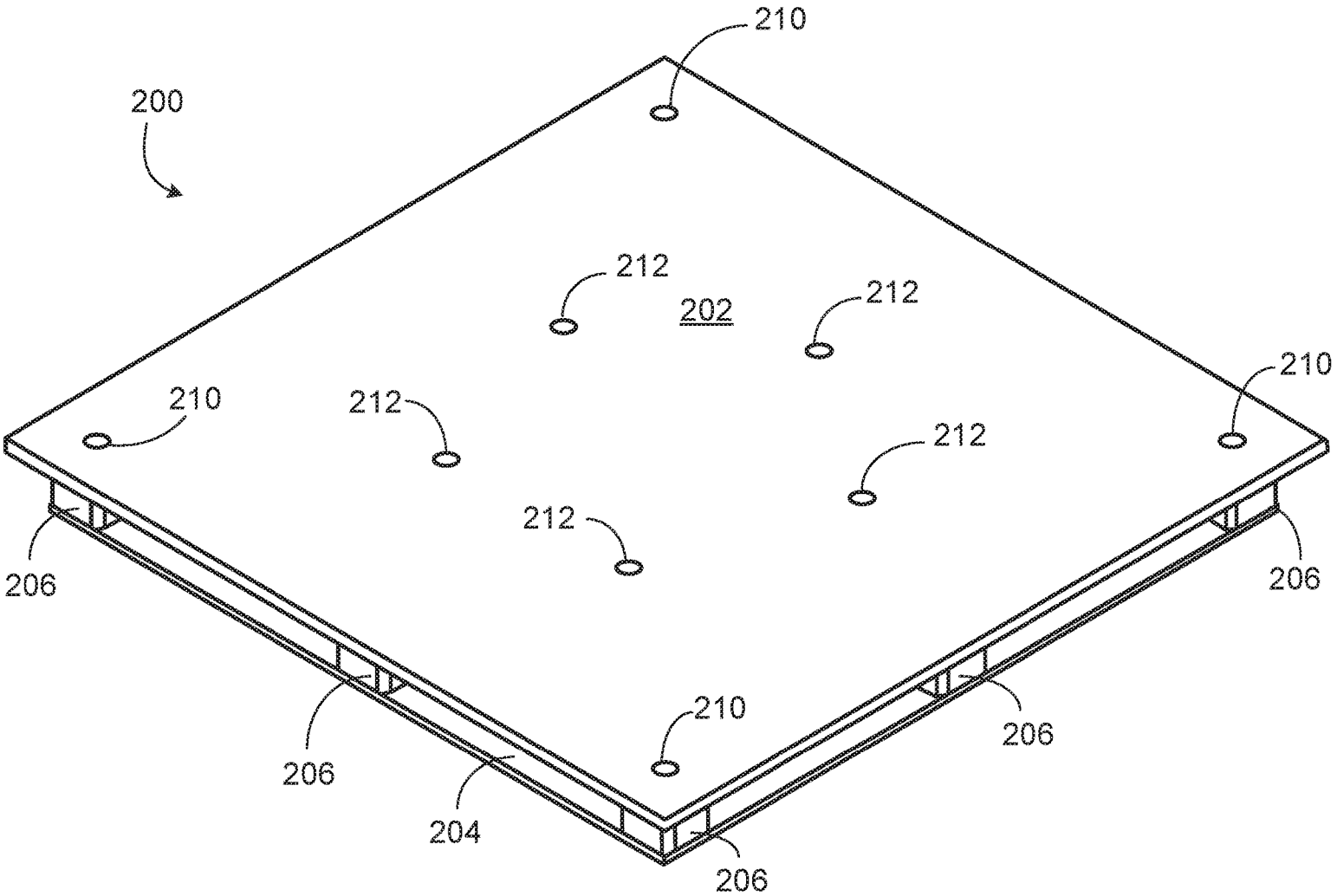
FIG. 5 is a perspective view of an exemplary pallet according to implementations of the present disclosure.

As shown in FIG. 5, top plate 202 includes a set of holes 210 that extend through top plate 202 and correspond with the location of holes 110 on base plate 102 of weapon maintenance stand 100. Holes 210 allow securing mechanisms, such as bolts, to be attached to pallet 200. These securing mechanisms inserted in holes 210 secure pallet 200 and its load to a surface, resulting in more control over the movement of pallet 200 and its load during transportation. In some implementations, holes 210 are aligned with the respective hollow interiors of a subset of support legs 206. In one implementation, holes 210 are located in the four corners of top plate 202. Holes 210 can be constructed to accommodate a variety of mechanisms used to secure pallet 200. Holes 210 may permit the weapon maintenance stand 100 and pallet 200 to be attached to a structure (e.g., a concrete pad or the bed of a truck).

Figure 7:
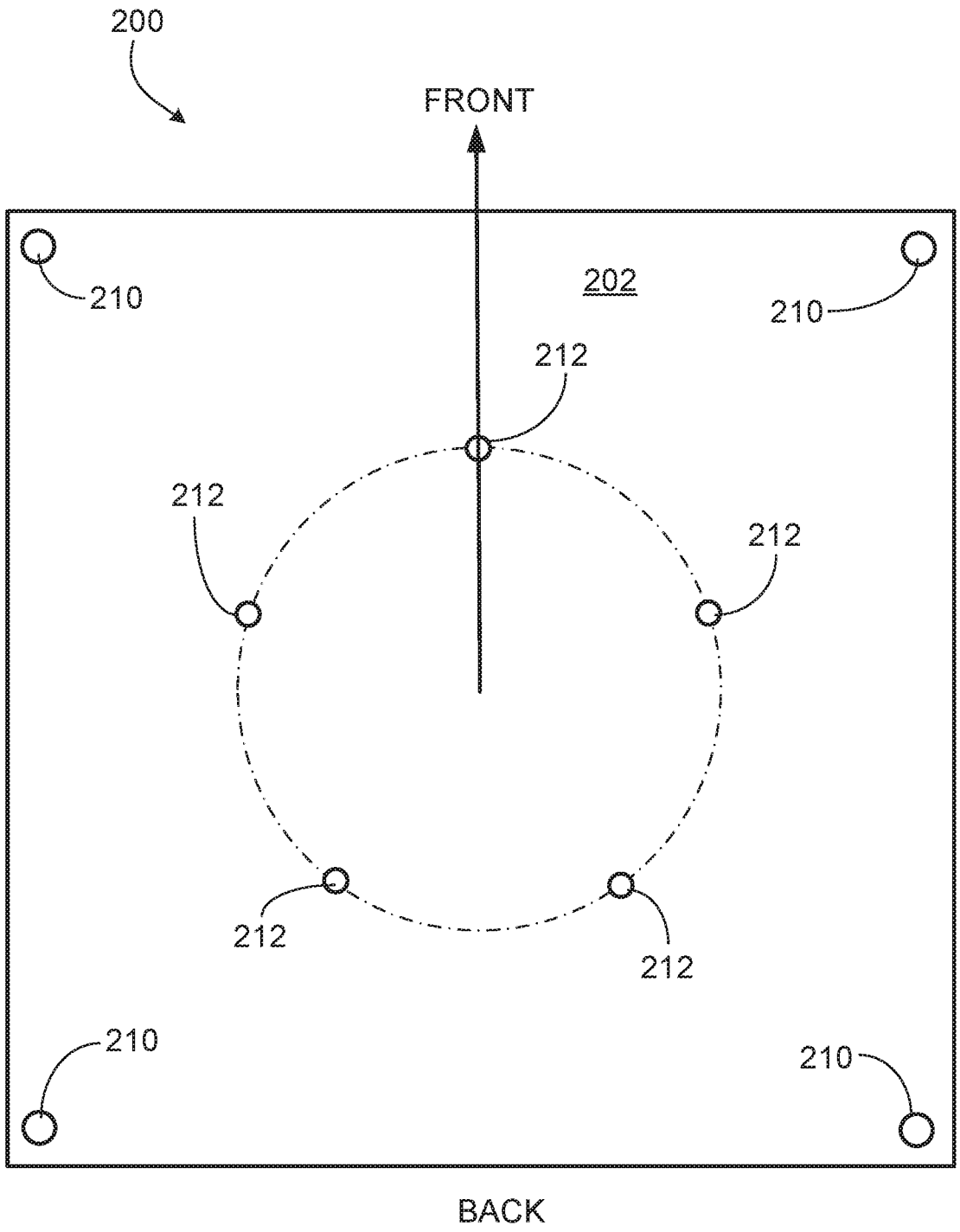
FIG. 7 is a top view of the pallet of FIG. 5, showing a bolt hole pattern of the pallet.

Top plate 202 includes another set of holes 212 that extend through top plate 202 and correspond with the location of holes 112 on base plate 202 of weapon maintenance stand 100. Holes 212 allow a weapon system to be secured to pallet 200 by providing opening for attachment of bolts on the weapon system to pallet 200. In one implementation, holes 212 are circular-shaped. In other implementations, holes 212 are the shape of slots. The use of a slot shape for holes 212 permits movement, such as alignment, of a weapon system on pallet 200. The number and location of holes 112 can correspond to a particular weapon system to be mounted on pallet 200. For example, FIG. 7 illustrates a top plate 202 with five holes 212 disposed in a pentagon shape around the center of top plate 202 and centered toward the front of top plate 202.

Pallet 200 also includes a base structure 204. Base structure 204 defines a central void in pallet 200. In one implementation, base structure 204 is rectangular-shaped. In other implementations, base structure 204 is square-shaped. In some implementations, base structure 204 may be other shapes (e.g., round or triangular) or sizes depending on the desired application. In some implementations, base structure 204 can be constructed to accommodate particular weapon systems. For example, base structure 204 can be 48 inches by 48 inches, 48 inches by 40 inches, 60 inches by 36 inches, 36 inches by 36 inches, or 24 inches by 24 inches.

Figure 6:
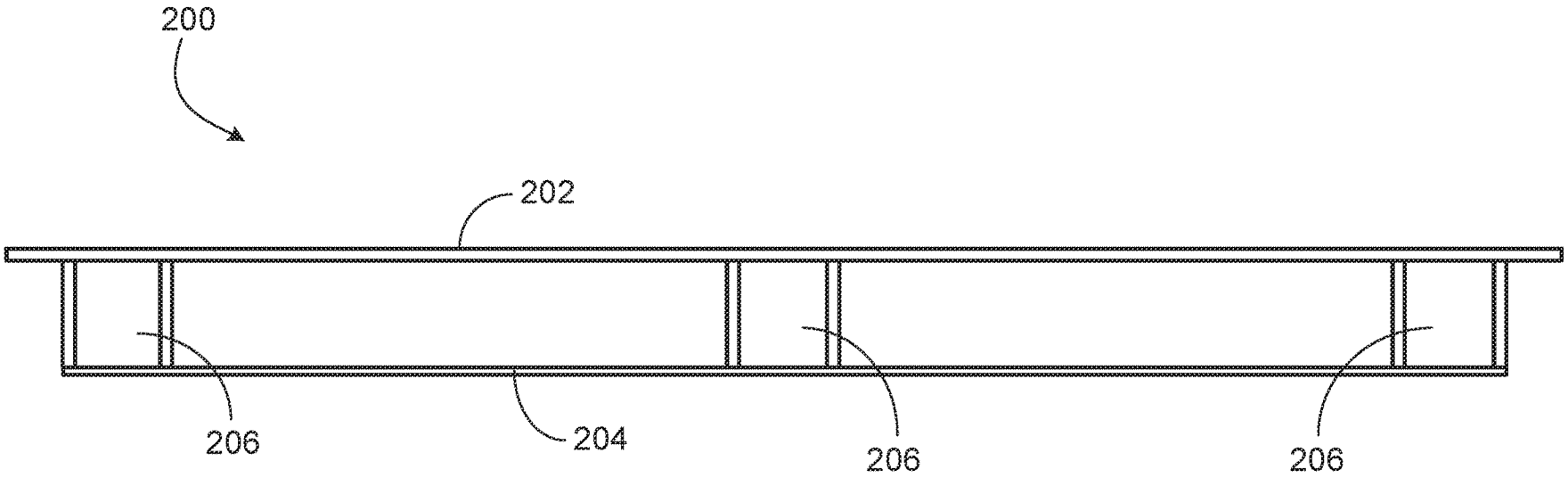
FIG. 6 is a side view of the pallet of FIG. 5.
Figure 8:
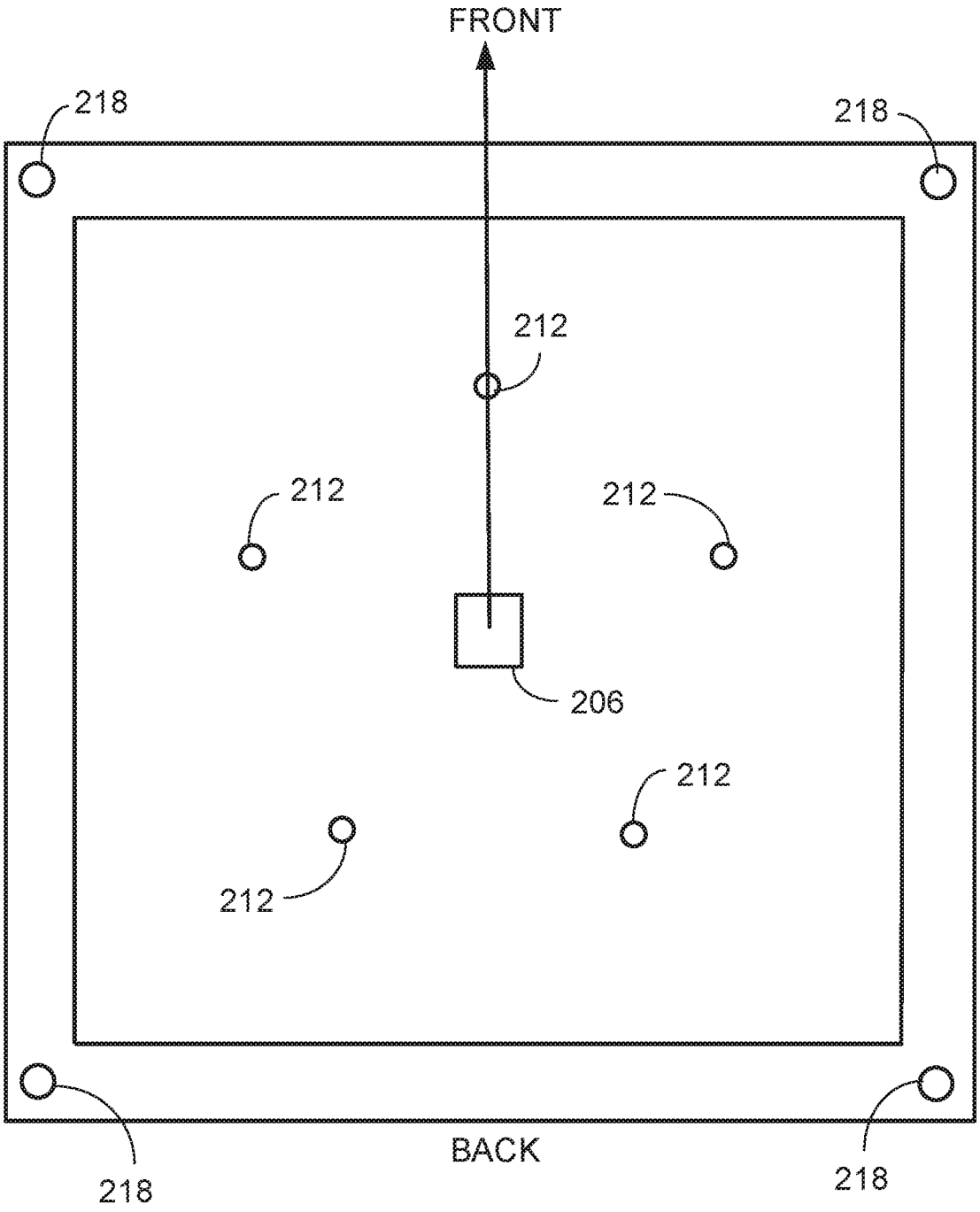
FIG. 8 is a bottom view of a portion of the pallet of FIG. 5, showing an internal structure of the pallet.

As shown in FIG. 6, top plate 202 and base structure 204 of pallet 200 are separated by support legs 206. Support legs 206 are attached to top plate 202 at one end and base structure 204 at an opposite end. Support legs 206, when welded or joined, are welded or joined by placing pallet 200 in a welding fixture (or jig) that forces the pallet 200 to deform slightly so that when support legs 206 are joined to top plate 202 and base structure 204, and pallet 200 is removed from the welding jig, support legs 206 are under some tension around the periphery, which allows for a stronger and more stable pallet 200. In one implementation, the support legs 206 can be formed as square posts. In some implementations, support legs 206 may be other shapes (e.g., round, rectangular, or triangular) depending on the desired application. The number of support legs 206 used can be selected according to the intended load for pallet 200. For example, pallet 200 can includes eight peripheral support legs 206 (one in each corner of the pallet 200 and one at each mid-point of the edges,) and one central support leg 206, as shown in FIG. 8. In other implementations, a different quantity of support legs 206 can be used as desired and/or appropriate. Support legs 206 can be different heights as desired and/or appropriate. In some implementations, support legs 206 are 4 inches tall.

As shown in FIG. 8, base structure 204 of pallet 200 includes an additional set of holes 218 that extend through base structure 204. Holes 218 allow for pallet 200 to be secured during transport by providing an opening for securing mechanisms, such as bolts, to be attached to pallet 200. Holes 218 correspond to the respective locations of holes 110 on base plate 102 of weapon maintenance stand 100 and holes 210 on top plate 202 of pallet 200. In some implementations, holes 218 are aligned with the respective hollow interiors of a subset of support legs 206. In one implementation, holes 218 are located in the four corners of base structure 204.

Figure 9:
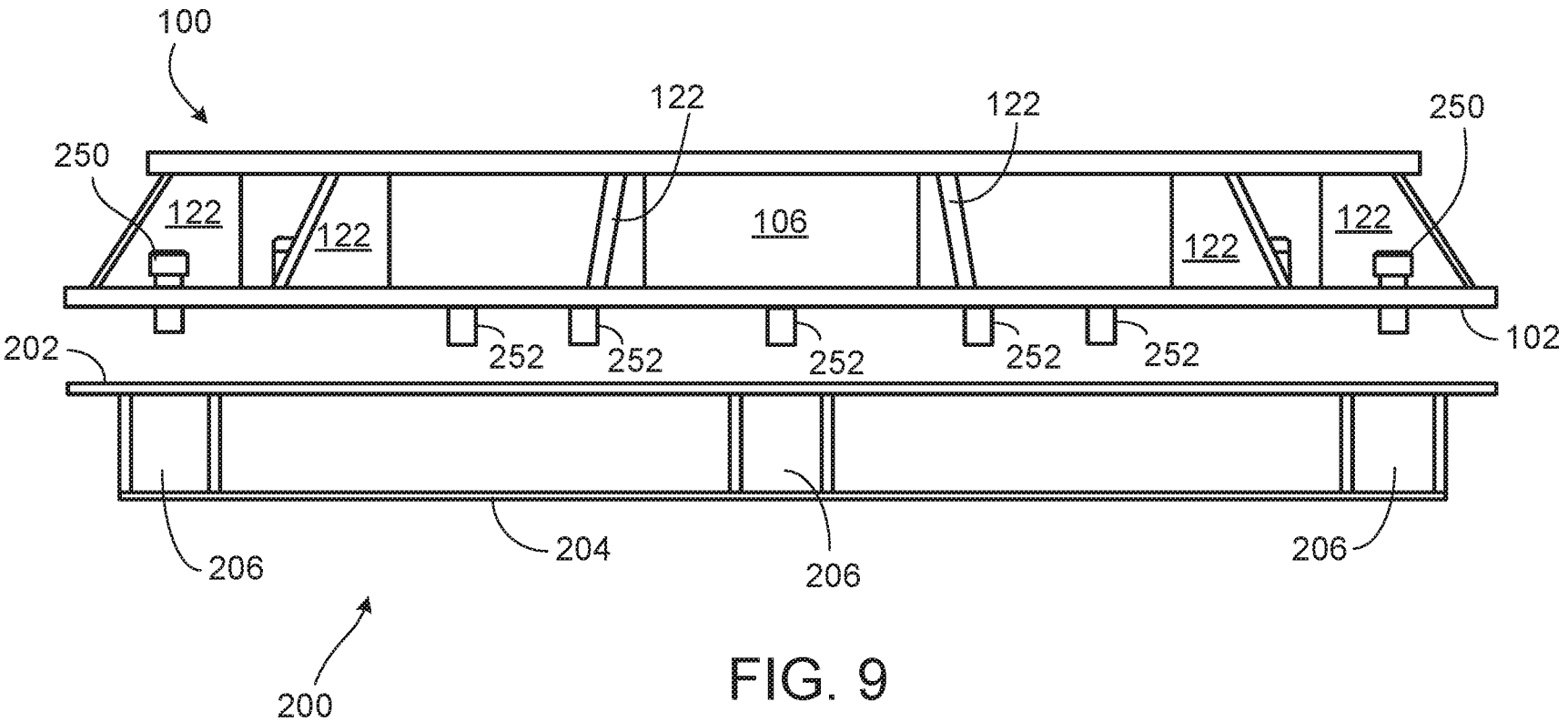
FIG. 9 is a side view of a weapon maintenance stand being mounted to a pallet forming a weapon maintenance system.

FIG. 9 is a side view of a weapon maintenance system. FIG. 9 demonstrates an exemplary weapon maintenance stand 100 being placed on an exemplary pallet 200. Base plate 102 of weapon maintenance stand 100 is aligned with top plate 202 and base structure 204 of pallet 200. Bolts 252 of the weapon system are aligned with holes 112 on base plate 102 and holes 212 on top plate 202. Securing bolts 250 are aligned with holes 110 on base plate 102, holes 210 on top plate 202, and holes 218 on base structure 204. The securing bolts 250 are used to secure weapon maintenance stand 100 to pallet 200 and pallet 200 to a fixed surface. In one implementation, holes 110, holes 210, and holes 218 are all aligned with the respective hollow interiors of a subset of support legs 206. In another implementation, holes 110, holes 210, and holes 218 are located in the four corners of base plate 102, top plate 202, and base structure 204, respectively.

FIG. 10 illustrates a deck-mounted weapon system 300 being placed on weapon maintenance stand 100, which is on top of pallet 200. The umbilicals 302 are aligned with umbilical guide structure 108 on weapon maintenance stand 100 and can pass through umbilical guide tunnels 120 of the umbilical guide structure 108 and tunnels 118 in wall structure 106 of weapon maintenance stand 100. By being able to pass through umbilical guide tunnels 120 and tunnels 118, a weapon system's umbilicals 302 are less likely to be damaged during transport and maintenance of the weapon system. Once attached to weapon maintenance stand 100, the deck-mounted weapon system 300 can be secured by bolting the deck mounted weapon system 300 to weapon maintenance stand 100 and pallet 200. This allows the deck-mounted weapon system 300 to be transported safely using a forklift. Pallet 200 can then be further bolted to a surface (e.g., a concrete pad, a trailer bed, or truck bed) to eliminate any unwanted movement of the deck mounted weapon system 300 during transportation or maintenance of deck mounted weapon system 300. This weapon maintenance system facilitates safe and controlled transportation and maintenance of deck-mounted weapon systems 300.

Figure 11:
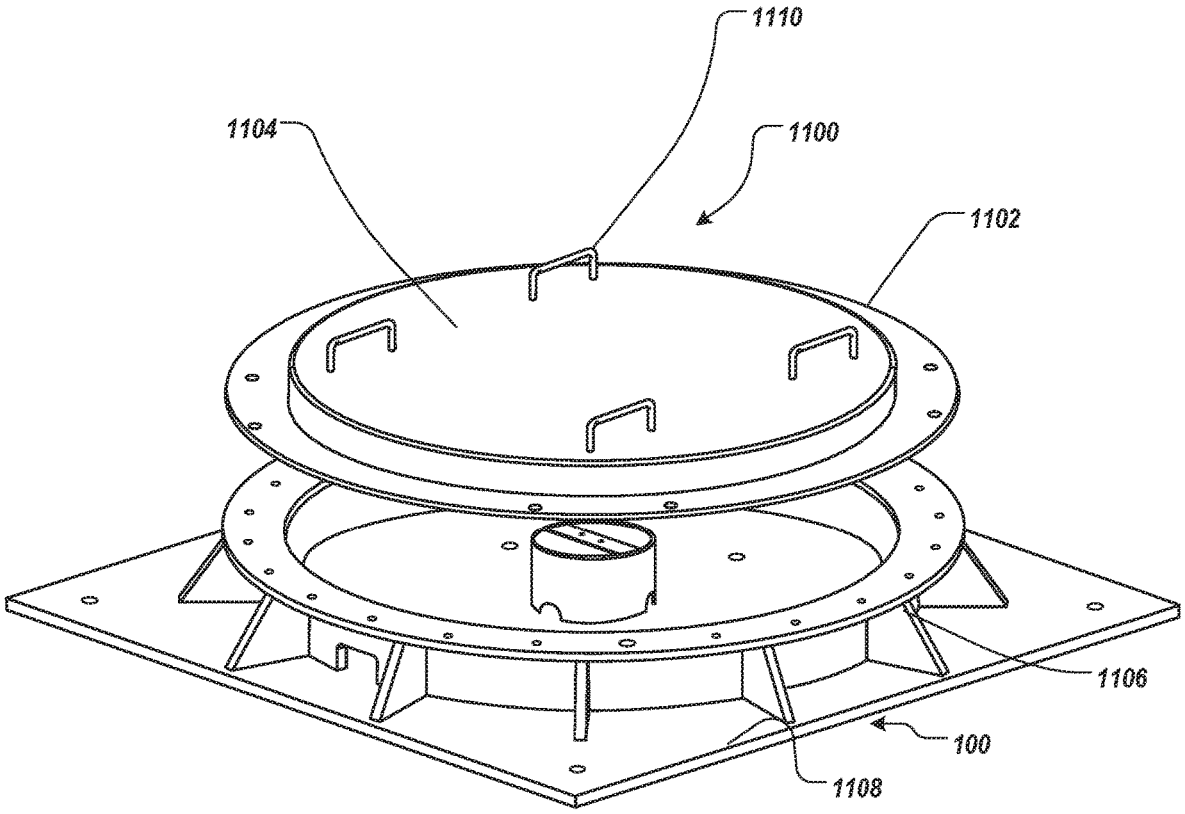
FIG. 11 is a perspective view of a weapon maintenance cover being mounted to a weapon maintenance stand.
Figure 12:
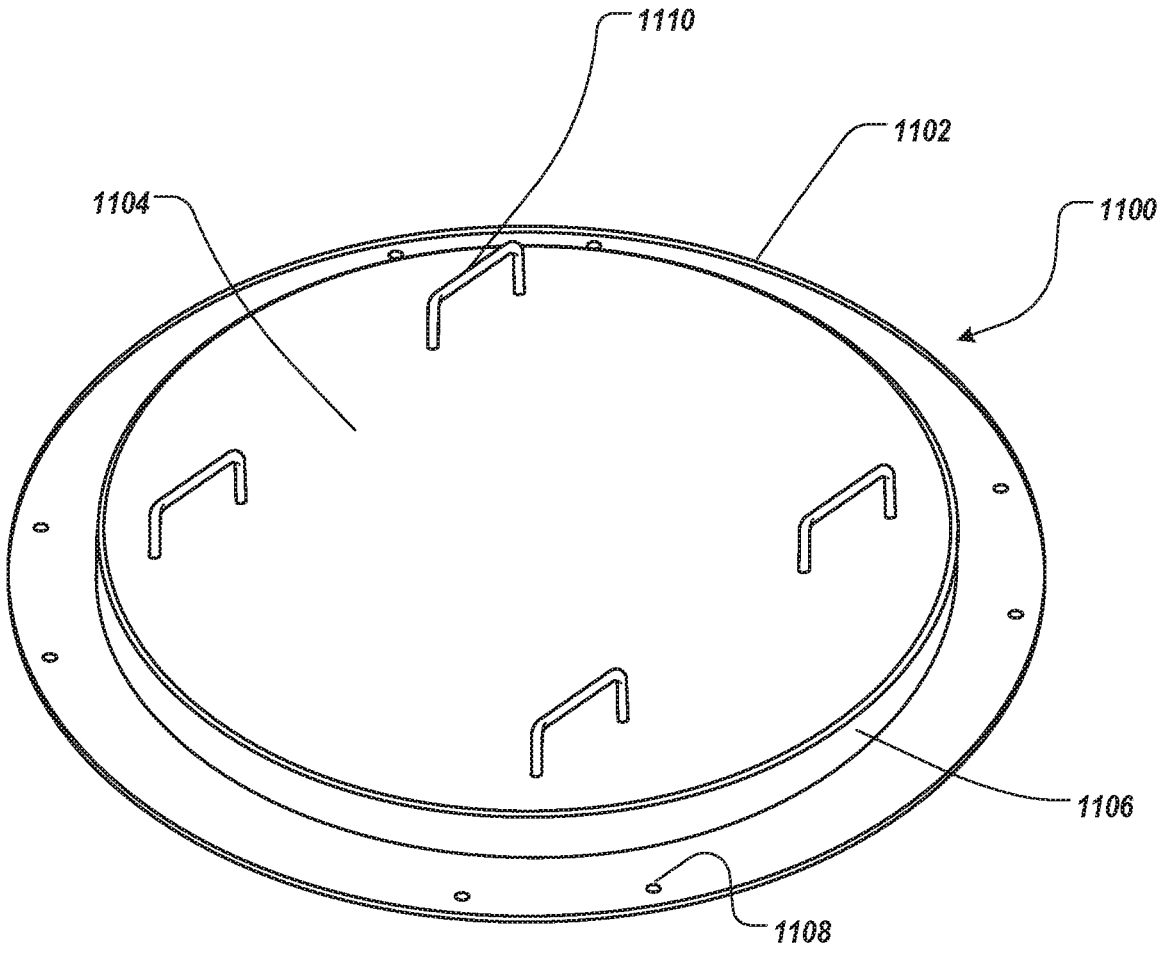
FIG. 12 is a perspective view of a weapon maintenance cover.
Figure 13:
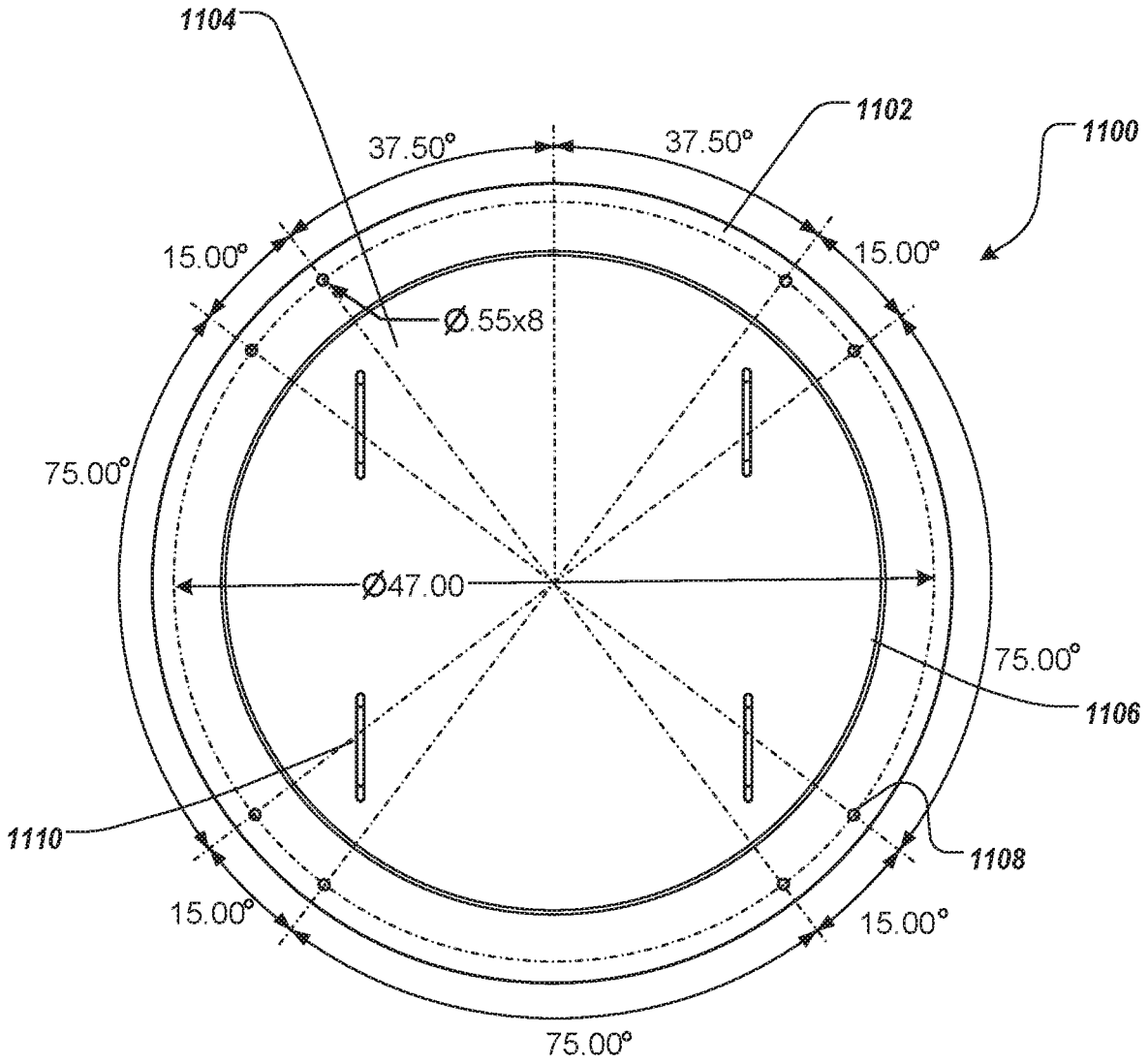
FIG. 13 is a top view of a weapon maintenance cover.

FIGS. 11-13 show perspective and top views of an exemplary weapon maintenance cover 1100. FIG. 11 illustrates a weapon system cover 1100 in relation to weapon maintenance stand 100. With reference to FIGS. 11-13, the weapon maintenance cover 1100 includes a top plate 1104 with a wall structure 1106 extending away from an outer edge of the top late 1104 and a flange 1102 extending outward from a bottom edge of the wall structure 1106. The wall structure 1104 extends downward from the cover plate 1104 in a direction substantially perpendicular to a bottom surface of the cover plate 1104. Wall structure 1106 can be welded to the cover plate 1104. The flange 1102 extends around a perimeter of the wall structure 1106 and can be welded to the bottom edge of the wall structure 1106. The flange 1102 is sized to mate with the support flange 104 of weapon maintenance stand 100. Flange 1102 defines a plurality of holes 1108 that can be arranged in a spaced-apart pattern around the flange 1102. In some implementations, the holes 1108 are arranged in a pattern that aligns with at least a subset of holes 114/116 in the weapon maintenance stand support flange 104 (see e.g., FIGS. 1 and 3).

Figure 14:
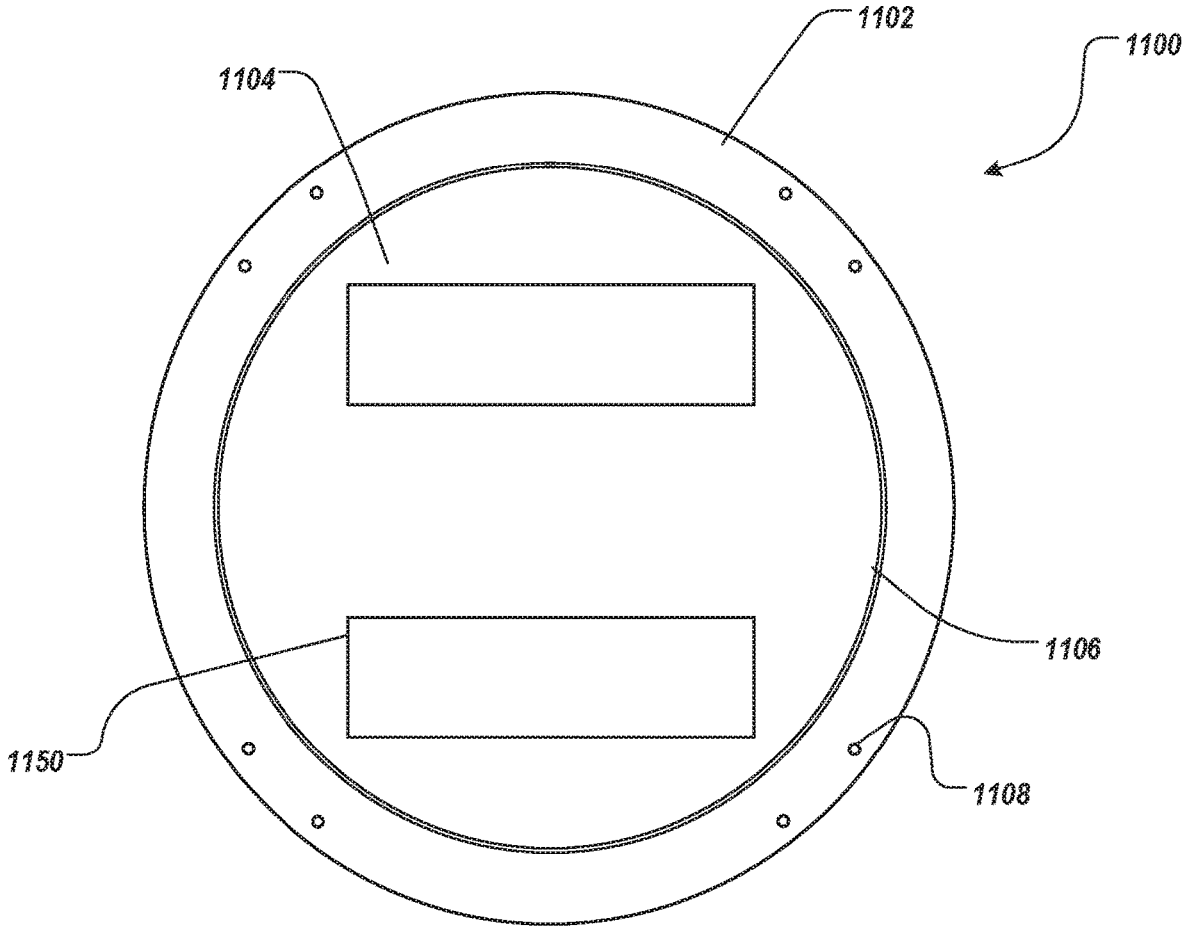
FIG. 14 is a top view of a second embodiment of the weapon maintenance cover.
Figure 15A:
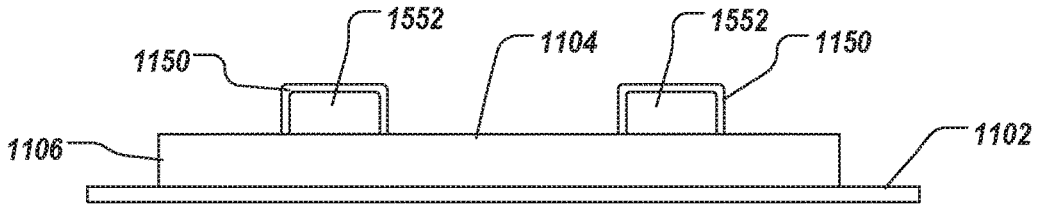
FIG. 15A is a side view of the weapon maintenance cover of FIG. 14.
Figure 15B:
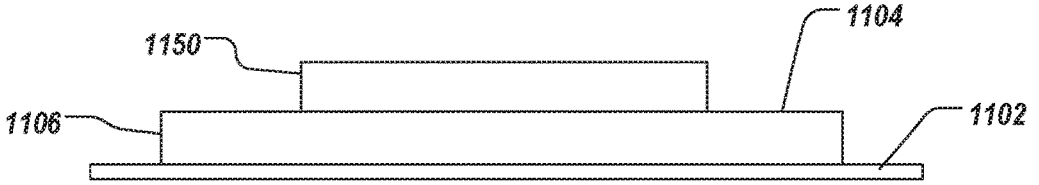
FIG. 15B is a front view of the weapon maintenance cover of FIG. 14.

In some implementations, weapon maintenance cover 1100 includes at least one lifting structure 1110 (e.g., a handle or a channel as depicted in FIGS. 14-15B). The lifting structure permits safe transportation of the cover 1100 by forklift, pallet jack, or other industrial vehicle.

As shown in FIG. 12, flange 1102 has a circular shape. For example, base plate 102 can be a 49.5 inches in diameter. In some implementations, flange 1102 may be other shapes (e.g., rectangular or triangular) or sizes depending on the desired application. In other implementations, flange 1102 can be constructed to accommodate particular weapon systems (e.g., Mk38 25 mm machine gun, MK110, MK15 Phalanx, Raytheon SeaRAM). For example, flange 1102 can be 56 inches in diameter, 48 inches in diameter, 48 inches in diameter, 36 inches in diameter, or 24 inches in diameter. In another example, flange 1102 can be 56 inches by 56 inches, 48 inches by 48 inches, 48 inches by 40 inches, 60 inches by 36 inches, 36 inches by 36 inches, or 24 inches by 24 inches.

Holes 1108 provide openings for securing mechanisms, such as bolts, to be attached to weapon maintenance cover 1100. This allows weapon maintenance cover 1100 to be secured during transportation and maintenance to the weapon maintenance stand 100 or an opening in a ship deck from which a weapons system has been removed for maintenance. For example, holes 1108 in the cover 1100 can be patterned to align with holes 114 of the weapon maintenance stand 100 (e.g., FIGS. 1 and 3). Holes 1108 are located outside the perimeter defined by the wall structure 1106. In one implementation, holes 1108 are located in the four corners of flange 1102. Holes 1108 can be constructed to accommodate a variety of mechanisms or fasteners used to secure cover 1100 (e.g., bolts). Flange 1102 is attached to wall structure 1106 of weapon maintenance cover 1100. In one implementation, flange 1102 can be joined to wall structure 1106 using welding techniques. Flange 1102 defines a central void on weapon maintenance stand 100.

As shown in FIG. 13, holes 1108 can be offset from the front of weapon maintenance cover 1100, for example, to match the location of holes on a particular type of weapon system base, ship deck, or vehicle. For example, one of holes 1108 can be spaced approximately 37.5 degrees from an axis of flange 1102 that extends between a front and a back of flange 1102 to match a first hole of a Mk38 weapon system. A second one of holes 1108 can then further be spaced approximately 15 degrees from a first hole. Holes 1108 can also be constructed with different diameters to accommodate different weapon systems.

Wall structure 1106 of weapon maintenance cover 1100 is attached to both flange 1102 and top plate 1104. In some implementations, wall structure 1106 of weapon maintenance cover 1100 can be supported by a set of braces. For example, braces (similar to braces 122 shown in FIG. 3 on the weapon maintenance stand 100) can be attached at various locations between the wall structure 1106 and the flange 1102. In some implementations, braces can be attached using welding techniques. Braces may provide additional support to wall structure 1106.

In some implementations, the size, location, and number of holes 1110 can be selected based on a desired weapon system hole to be covered, corresponding to the weapon maintenance stand 100, deck, or vehicle.

Weapon maintenance cover 1100 can be configured to accommodate a variety of weapon systems (e.g., Mk38 25 mm machine gun, MK15 Phalanx, Raytheon SeaRAM, Mk110 57 mm Gun System). For example, the holes 1110 on weapon maintenance cover 1100 can be different shapes (rectangular, circular, oval, square, star-shaped, t-slotted, etc.) to accommodate strapping, banding, bolts, ratchet straps, other proprietary fastening systems. Weapon maintenance cover 1100 can be formed from a variety of materials, such as steel or aluminum.

In some implementations, weapon maintenance cover 1100 can have a "channel-type" lifting structure. FIG. 14 shows a top view of a weapon maintenance cover 1100 with a "channel-type" lifting structures 1150. FIGS. 15A and 15B show front and side views, respectively, of the weapon maintenance cover 1100 with a "channel-type" lifting structures 1150. For example, lifting structures 1150 are formed as elongated enclosures that define a channel 1552 extending therethrough. The internal width of each channel is sized to receive a forklift fork. The lifting structures 1150 are spaced apart from each other and attached to the upper surface of the cover plate 1104. For example, lifting structures 1150 can be welded to the upper surface of the cover plate 1104.

Particular embodiments of the subject matter have been described. Other embodiments are within the scope of the following claims. For example, the actions recited in certain claims can be performed in a different order and still achieve desirable results. As one example, the processes depicted in the accompanying figures do not necessarily require the particular order shown, or sequential order, to achieve desirable results.

What is claimed is:

1. A weapon support system comprising:

a weapon maintenance stand comprising:

a base plate defining a first plurality of holes extending through the base plate and a second plurality of holes extending through the base plate, a support flange spaced from the base plate, the support flange defining a third plurality of holes extending through the support flange, a wall structure attached to the base plate at a first end and attached to the support flange at a second end, the wall structure defining a tunnel extending through the wall, a plurality of braces attached to the wall structure and the base plate to support the wall structure, an umbilical guide structure attached to the base plate and located within a perimeter defined by the wall structure, and a deck-mounted weapon system mounted to the support flange such that umbilical components of the deck-mounted weapon system pass through the umbilical guide structure and through the tunnel, wherein a subset of the third plurality of holes are configured to match a pattern of bolt holes of a deck-mounted weapon system and at least one of the third plurality of holes is configured to receive an alignment structure of the deck-mounted weapon system, and wherein the first plurality of holes are located outside of the perimeter and the second plurality of holes are located inside the perimeter;

a weapon maintenance stand cover configured to mate with the support flange of the weapon maintenance stand with the deck-mounted weapon system unmounted; and a pallet comprising:

a top plate defining a fourth plurality of holes extending through the top plate and a fifth plurality of holes extending through the top plate, locations of the fourth plurality of holes corresponding to respective locations of the first plurality of holes of the weapon maintenance stand base plate and locations of the fifth plurality of holes corresponding to respective locations of the second plurality of holes of the weapon maintenance stand base plate;

a base structure spaced apart from the top plate, and a plurality of support legs attached to the top plate at respective first ends, and, at least a portion of the plurality of support legs being attached to the base structure at respective second ends.

2. The weapon support system of claim 1, wherein the weapon maintenance stand cover comprises:

a top cover plate;

a wall structure extending away from an outer edge of the top cover plate and in a direction substantially perpendicular to a bottom surface of the top cover plate;

a flange extending outward from a bottom edge of the wall structure and around a perimeter of the wall structure, wherein the flange is sized to mate with a support flange of a weapon maintenance stand.

3. The weapon support system of claim 2, wherein the flange defines a sixth plurality of holes extending therethrough, the sixth plurality of holes arranged in a spaced-apart pattern around the flange, wherein the pattern of the sixth plurality of holes matches with a subset of the third plurality of holes extending through the support flange of the weapon maintenance stand.

4. The weapon support system of claim 2, wherein the weapon maintenance stand cover comprises a first lifting structure and a second lifting structure attached to a top surface of the top cover plate and spaced apart from one another.

5. The weapon support system of claim 4, wherein both the first lifting structure and the second lifting structure are sized to receive a forklift fork.

6. The weapon support system of claim 5, wherein the first lifting structure comprises a first pair of handles and the second lifting structure comprises a second pair of handles.

7. The weapon support system of claim 5, wherein each of the first lifting structure and the second lifting structure comprise an elongated enclosure defining a channel extending between openings at each end of the enclosure, wherein a width of each opening is sized to receive a forklift fork.

8. The weapon support system of claim 1, wherein the deck-mounted weapon system is a MK-38 weapon system.

9. A weapon maintenance system comprising:

a base plate;

a support flange spaced from the base plate, the support flange defining a first plurality of holes extending through the support flange;

a wall structure attached to the base plate at a first end and attached to the support flange at a second end, the wall structure defining a tunnel extending through the wall;

a deck-mounted weapon system mounted to the support flange such that umbilical components of the deck-mounted weapon system pass through the tunnel, wherein a subset of the first plurality of holes are configured to match a pattern of bolt holes of a deck-mounted weapon system and at least one of the first plurality of holes is configured to receive an alignment structure of the deck-mounted weapon system; and a cover configured to mate with the support flange with the deck-mounted weapon system unmounted.

10. The weapon maintenance system of claim 9, wherein the cover comprises:

a top cover plate;

a wall structure extending away from an outer edge of the top cover plate and in a direction substantially perpendicular to a bottom surface of the top cover plate;

a flange extending outward from a bottom edge of the wall structure and around a perimeter of the wall structure, wherein the flange is sized to mate with a support flange of a weapon maintenance stand.

11. The weapon maintenance system of claim 10, wherein the flange defines a second plurality of holes extending therethrough, the second plurality of holes arranged in a spaced-apart pattern around the flange, wherein the pattern of the second plurality of holes matches with a subset of the first plurality of holes extending through the support flange of the weapon maintenance stand.

12. The weapon maintenance system of claim 10, wherein cover comprises a first lifting structure and a second lifting structure attached to a top surface of the top cover plate and spaced apart from one another.

13. The weapon maintenance system of claim 12, wherein both the first lifting structure and the second lifting structure are sized to receive a forklift fork.

14. The weapon maintenance system of claim 13, wherein the first lifting structure comprises a first pair of handles and the second lifting structure comprises a second pair of handles.

15. The weapon maintenance system of claim 13, wherein each of the first lifting structure and the second lifting structure comprise an elongated enclosure defining a channel extending between openings at each end of the enclosure, wherein a width of each opening is sized to receive a forklift fork or lifting slings.

16. A weapon maintenance stand cover comprising:

a top cover plate;

a wall structure extending away from an outer edge of the top cover plate and in a direction substantially perpendicular to a bottom surface of the top cover plate;

a flange extending outward from a bottom edge of the wall structure and around a perimeter of the wall structure, wherein the flange is sized to mate with a support flange of a weapon maintenance stand, and wherein the flange defines a first plurality of holes extending therethrough, the first plurality of holes arranged in a spaced-apart pattern around the flange that aligns with a subset of a second plurality of holes arranged around the support flange of the weapon maintenance stand; and a first lifting structure and a second lifting structure attached to a top surface of the top cover plate and spaced apart from one another, wherein both the first lifting structure and the second lifting structure are sized to receive a forklift fork.

17. The weapon maintenance stand cover of claim 16, wherein the first lifting structure comprises a first pair of handles and the second lifting structure comprises a second pair of handles.

18. The weapon maintenance stand cover of claim 16, wherein each of the first lifting structure and the second lifting structure comprise an elongated enclosure defining a channel extending between openings at each end of the enclosure, wherein a width of each opening is sized to receive a forklift fork or lifting slings.

19. The weapon maintenance stand cover of claim 16, wherein weapon maintenance stand cover comprises at least one of steel and aluminum.

20. The weapon maintenance stand cover of claim 16, wherein the flange comprises a circular-shape defining a central void.

* * * * *